United States Patent [19]

Bodet

[11] Patent Number: 4,819,563

[45] Date of Patent: Apr. 11, 1989

[54] BULLETS FOR FIRE ARMS

[76] Inventor: Fabrice Bodet, 55, rue de St. Cloud, 92410 Ville D'Avray, France

[21] Appl. No.: 737,570

[22] Filed: May 23, 1985

Related U.S. Application Data

[63] Continuation of Ser. No. 612,681, May 22, 1984, abandoned, which is a continuation of Ser. No. 40,647, May 21, 1979, abandoned.

[30] Foreign Application Priority Data

Jun. 19, 1978 [FR] France ..... 78 18260

[51] Int. Cl.[4] ..... F42B 11/00

[52] U.S. Cl. ..... 102/501; 102/514

[58] Field of Search ..... 102/501, 507–519; 273/428

[56] References Cited

U.S. PATENT DOCUMENTS

| | | |
|---|---|---|
| 1,178,516 | 4/1916 | Hardcastle . |
| 1,187,867 | 6/1916 | Shinkle . |
| 1,582,673 | 4/1966 | Fahrenwald . |
| 3,877,381 | 4/1975 | McCoy . |
| 3,880,083 | 4/1975 | Wasserman et al. . |

FOREIGN PATENT DOCUMENTS

| | | |
|---|---|---|
| 104738 | 5/1898 | Fed. Rep. of Germany . |
| 1253485 | 1/1961 | France . |
| 2370949 | 6/1978 | France . |
| 564450 | of 1957 | Italy . |
| 38237 | 11/1906 | Switzerland . |

OTHER PUBLICATIONS

Army Ordnance, vol. XII, No. 72, pp. 396–401, May, June 1932.

*Primary Examiner*—Harold J. Tudor

*Attorney, Agent, or Firm*—Parmelee, Bollinger & Bramblett

[57] ABSTRACT

The invention relates to a bullet for a portable fire arm of a caliber between 5 and 12 mm.

This bullet is formed by a solid homogeneous monobloc piece, made from copper or a copper alloy, having the outer form of a cylinder of revolution connected along a sharp edge to a cone of revolution whose angle at the apex is equal to 60°.

The preferred application is for close attack and defense hand weapons.

5 Claims, 1 Drawing Sheet

BULLETS FOR FIRE ARMS

This is a continuation of application Ser. No. 612,681, filed on May 22, 1984, now abandoned, which is a continuation of application Ser. No. 040,647, filed on May 21, 1979, now abandoned.

This invention relates to small calibre bullets or projectiles for portable fire arms, said calibre being between 5 and 12 mm and preferably of the order of 9 mm.

It relates more particularly, among these bullets, to those whose outer surface is in the form of a cylinder of revolution connected along a sharp edge to a coaxial cone of revolution whose angle at the apex is between 50° and 80°, this angle being preferably of the order of 60°.

It relates also to cartridges equipped with such bullets.

Known bullets of this kind have a very low density, preferably between 1 and 3 g/cm$^3$, for which said bullets are generally formed from a light material (polymer or magnesium) and are hollowed out axially for receiving a medicament or a vaccine : the purpose of the bullets in question is in fact to implant medicaments in the flesh of living animals without seriously injuring these latter, the firing of said bullets being effected at subsonic speed.

The bullets of the invention answer a different purpose : they are intended to be fired at supersonic speed by means of hand or shoulder weapons, in particular by means of automatic pistols and it is desired to obtain with them relatively destructive impact effects at close range, while reducing their harmfulness at long range as well as their cost price.

To this end, the bullets in question, having the above defined outer shape—and not one of the cylindro-ogival shapes without a sharp angle generally known for dense metal bullets—, are characterized in that they are formed by a solid homogeneous monobloc piece made from copper or copper alloy.

In preferred embodiments, recourse is had to one and/or the other of the following arrangements:

the axial length of the cylindrical zone of the bullet is less than that of its conical zone, the first being preferably of the order of 5 mm for a calibre of 9 mm, the bullet is enveloped in a thin film of silicone.

The invention comprises, apart from these main arrangements, certain other arrangements which are preferably used at the same time and which will be more explicitly discussed hereafter.

In what follows, there will be described a preferred embodiment of the invention with reference to the accompanying drawing, in a manner which is of course in no wise limiting.

Figure 1:
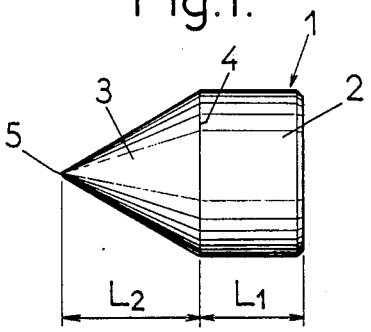

FIG. 1 of this drawing shows a side view on an enlarged scale of a bullet constructed according to the invention.

Figure 2:
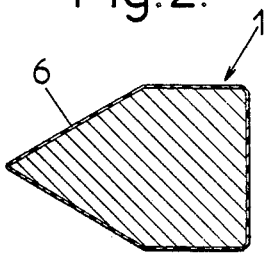

FIG. 2 shows the same bullet in axial section.

The bullet in question, designated generally by the reference 1 in the drawing, is formed of a monobloc piece made from copper or a copper alloy defined outwardly, in its rear half, by a cylinder of revolution 2 and, in its front half, by a cone of revolution 3 connected to cylinder 2 along a sharp edge 4.

The point 5 of the cone 3 is not blunt : it remains pointed in this sense that its contour is defined outwardly by a sphere with a radius at most equal to 0.5 mm.

The angle at the apex of cone 3 is between 50° and 80°, being preferably equal to 60°.

The axial length $L_1$ of the cylindrical rear zone is less than the axial length $L_2$ of the front conical zone 3 : this length $L_1$ is for example 5 mm for a calibre of 9 mm and a length $L_2$ of the order of 8 mm.

The bullet thus described is very light : it weighs only 4 to 5 grammes instead of 8 grammes for the usual bullets of the same calibre.

In a way known per se, this bullet is coated with a thin film 6 (FIG. 2) formed of a "lubricating" material facilitating the sliding of the bullet into the barrel of the weapon and its penetration in the air and in solids, a material formed particularly by a silicone or a fluorated polymer. The thickness of this film is some tens of microns The above bullet is fitted in the usual way in the mouth of a case (not shown) charged with explosive to form a cartridge : because of the relative lightness of said bullet, this explosive is here a specially quick-burning powder of the kind used in the manufacture of cartridges for supplying certain rapid fire hunting weapons.

Experience shows that the conicity of the front pointed end of the bullet facilitates the automatic loading of the cartridge instead of making it more delicate, as may be at first feared : in fact, the semi-angle at the apex of this cone is generally greater than the slope of the feed mechanism with respect to the axis of the barrel, so that, even if the breech is sharply closed, there is no risk of "battering" the front surface of the bullet against the internal wall opposite this breech, battering which could cause jamming; such a closing of the breech ensures on the contrary in every case a correct tilting of the short and pointed cartridges fitted with bullets of the invention.

The firing of such a bullet leads to the following findings :

because its weight is substantially half the weight of the usual comparable bullets, its starting speed is about twice as high as the starting speed of said usual bullets : this speed is then clearly greater than the speed of sound and particularly of the order of 550 to 600 meters per second, moreover, the presence of convex angular zones (sharp edge 4 and point 5) on the outer surface of the bullet causes, at the high firing speed indicated, the creation of shock waves which, at impact, create an explosive effect (a phenomenon known under the name of "hydraulic compression" and "cavitation").

In other words, the impact of such a bullet fired at close range at a living being (man or animal) causes a relatively serious wound by bursting the flesh.

On the other hand, because of its lightness, the bullet in question loses its speed and so its energy over a shorter distance than the usual bullets of the same calibre and becomes practically inoffensive at long range or after passing through a first obstacle.

In other words, the efficiency of firing at point blank or at a close object is increased, whereas on the contrary the danger of "lost" bullets is decreased, which constitutes a dual advantage for a large number of applications.

The reduction of the individual weight of the bullets considered, as well as the simplification of their manufacture, because of their homogeneous construction, lead furthermore to a reduction in price.

Of course, the bullets in question may be used for other firing than that for close defence or attack, for example for testing the resistance of certain materials to impacts, perforations...

Following which, whatever the embodiment adopted, there is finally provided a bullet for portable fire arms whose construction and advantages (particularly the increased efficiency at close range, the reduced danger at medium range or at long range and the economy) follow sufficiently from what has gone before.

As is evident, and as it follows moreover already from what has gone before, the invention is in no wise limited to those of its modes of application and embodiments which have been more especially considered; it embraces, on the contrary, all variations thereof.

I claim:

1. A bullet for a portable firearm of a calibre between 5 and 12 mm, said bullet being formed of a solid homogeneous bloc piece of copper or copper alloy having an outer surface in the form of a cylinder of revolution connected along a sharp edge to a coaxial cone of revolution whose angle at the apex of said cone is between 50° and 80°, the axial length of said cylinder being smaller than the axial length of said cone and smaller than said calibre, said bullet when fired having a starting velocity greater than the speed of sound, said starting velocity being of the order of 550 to 600 meters per second, whereby the convex angular zone on the outer surface of said bullet creates shock waves which, on impact at close range, create an explosive effect; but said fired bullet loses its speed and energy over a short distance and is thereby ineffective at longer range or after passing through a first obstacle.

2. A bullet as claimed in claim 1 for a calibre of 9 mm in which the axial length of said cylinder is of the order of 5 mm.

3. A bullet as claimed in claim 2 in which the axial length of said cone is of the order of 8 mm.

4. A bullet as claimed in claim 1, 2 or 3, in which said angle at the apex is of the order of 60°.

5. A bullet as claimed in claim 1, 2 or 3, in which the apex of said cone is relatively sharp being defined outwardly by a sphere of radius no more than 0.5 mm.

* * * * *